US007176871B2

(12) United States Patent
Yeh

(10) Patent No.: US 7,176,871 B2
(45) Date of Patent: Feb. 13, 2007

(54) DIGITAL DATA DRIVER AND LCD USING THE SAME

(75) Inventor: Shin-Hung Yeh, Taipei (TW)

(73) Assignee: Au Optronics Corp., Hsinchu (TW)

( * ) Notice: Subject to any disclaimer, the term of this patent is extended or adjusted under 35 U.S.C. 154(b) by 489 days.

(21) Appl. No.: 10/699,363

(22) Filed: Oct. 31, 2003

(65) Prior Publication Data

US 2004/0227717 A1 Nov. 18, 2004

(30) Foreign Application Priority Data

May 15, 2003 (TW) ..... 92113173 A

(51) Int. Cl.
*G09G 3/36* (2006.01)

(52) U.S. Cl. ..... 345/98; 345/99; 345/100

(58) Field of Classification Search ..... 345/98, 345/99, 100

See application file for complete search history.

(56) References Cited

U.S. PATENT DOCUMENTS 6,256,024 B1 * 7/2001 Maekawa ..... 345/205
6,356,223 B1 * 3/2002 Tanaka ..... 341/144
6,693,616 B2 * 2/2004 Koyama et al. ..... 345/98
6,873,312 B2 * 3/2005 Matsueda ..... 345/98

* cited by examiner

*Primary Examiner*—Amr A. Awad
*Assistant Examiner*—Michael Pervan
(74) *Attorney, Agent, or Firm*—Thomas, Kayden, Horstemeyer & Risley

(57) ABSTRACT

A digital data driver and LCD using the same. In the digital data driver, a plurality of data lines, each transfer first data during a first period and second data during a second period. A first shift register outputs a first enable signal during the first period, a second shift register outputs a second enable signal during the second period. Transmission controllers are coupled to the data lines respectively, each outputs the first data and the second data to two different DAC according to the first and second enable signals and two external signals. The present invention, by sharing latches and DACs, prevents layout and wire routing difficulty caused by the increased lateral layout area required by increased LCD resolution.

15 Claims, 8 Drawing Sheets

DIGITAL DATA DRIVER AND LCD USING THE SAME

BACKGROUND OF THE INVENTION

1. Field of the Invention

The present invention relates to data drivers, and more particularly, to a digital data driver and a liquid crystal display using the same.

2. Description of the Related Art

Conventionally, digital drivers of active matrix liquid crystal display (AMLCD) use storage registers (digital latches) as line buffers to store the digital video signal in line time and to drive the Digital to Analog Converter (DAC) in a line-at-a-time mode. FIGS. 1A and 1B show the architecture of a conventional 6-bit digital data driver operating in line-at-a-time mode. According to this kind of architecture, the digital video data signals R[5]~B[0] are loaded into the first level corresponding latches (Latch11) by the enable signal from the shift register SRn during each horizontal scanning period. Thereafter, all video signals R[5]~B[0] stored in the first level latches (Latch11) are written to the second level latches (Latch12), and input to the DACs (DAC-Rn, DAC-Gn and DAC-Bn) simultaneously by the signal LB. According to the enable signal from the next shift register $SRn_{+1}$, the digital video data signals R[5]~B[0] on the data lines at present are loaded into the first level corresponding latches (Latch21). Next, all video signals R[5]~B[0] stored in the first level latches (Latch21) are written to the second level latches (Latch22), and input to the DACs($DAC\text{-}Rn_{+1}$, $DAC\text{-}Gn_{+1}$ and $DAC\text{-}Bn_{+1}$) simultaneously by the signal LB. As resolution of AMLCD is increased the bit numbers of the data also increases such that the numbers of the digital data driver occupy a larger layout area. In the conventional arrangement, however, the high resolution AMLCD suffers from the limited lateral layout area in the digital data driver. Thus, when the resolution of the AMLCD is increased, layout difficulty in wire routing caused by additional latches and DACs.

SUMMARY OF THE INVENTION

It is therefore an object of the present invention to avoid layout difficulty in wire routing caused by increased lateral layout area because of an increase in LCD resolution.

According to the above mentioned object, the present invention provides a digital data driver and an LCD that prevents layout difficulty in wire routing caused by increased lateral layout area because of an increase in LCD resolution, by sharing latches and DACs.

In the digital type data driver of the present invention, a plurality of data lines, each transfer first data during a first period and second data during a second period. A first shift register outputs a first enable signal during the first period, a second shift register outputs a second enable signal during the second period. Transmission controllers are coupled to the data lines respectively. Each outputs the first data and the second data to two different DAC according to the first and second enable signals and two external signals as third and fourth enable signals.

In each transmission controller, first and second switching devices are connected in parallel, each has a first terminal coupled to one of the data lines and a second terminal coupled to an input terminal of the first latch. Third and fourth switching devices are connected in parallel, each has a first terminal coupled to an output terminal of the first latch and a second terminal coupled to an input terminal of the second latch. Fifth and sixth switching devices are connected in parallel, each has a first terminal coupled to an output terminal of the second latch and a second terminal coupled to an input terminal of the third latch. A seventh switching device has a first terminal coupled to an output terminal of the third latch and a second terminal coupled to an input terminal of the fourth latch. A first inverter has an input terminal coupled to the output terminal of the third latch.

The first and third switching devices are turned on to store the first data in the second latch according to the first enable signal, the second switching device is turned on to store the second data in the first switching device according to the second enable signal, the fifth switching device and the seventh switching device are turned on to output the first data to the first DAC according to the third enable signal, and the fourth switching device and the sixth switching device are turned on to output the second data to the second DAC through the first inverter according to the fourth enable signal.

BRIEF DESCRIPTION OF THE DRAWINGS

The present invention can be more fully understood by the subsequent detailed description and examples with reference made to the accompanying drawings, wherein.

DETAILED DESCRIPTION OF THE INVENTION

Figure 2:
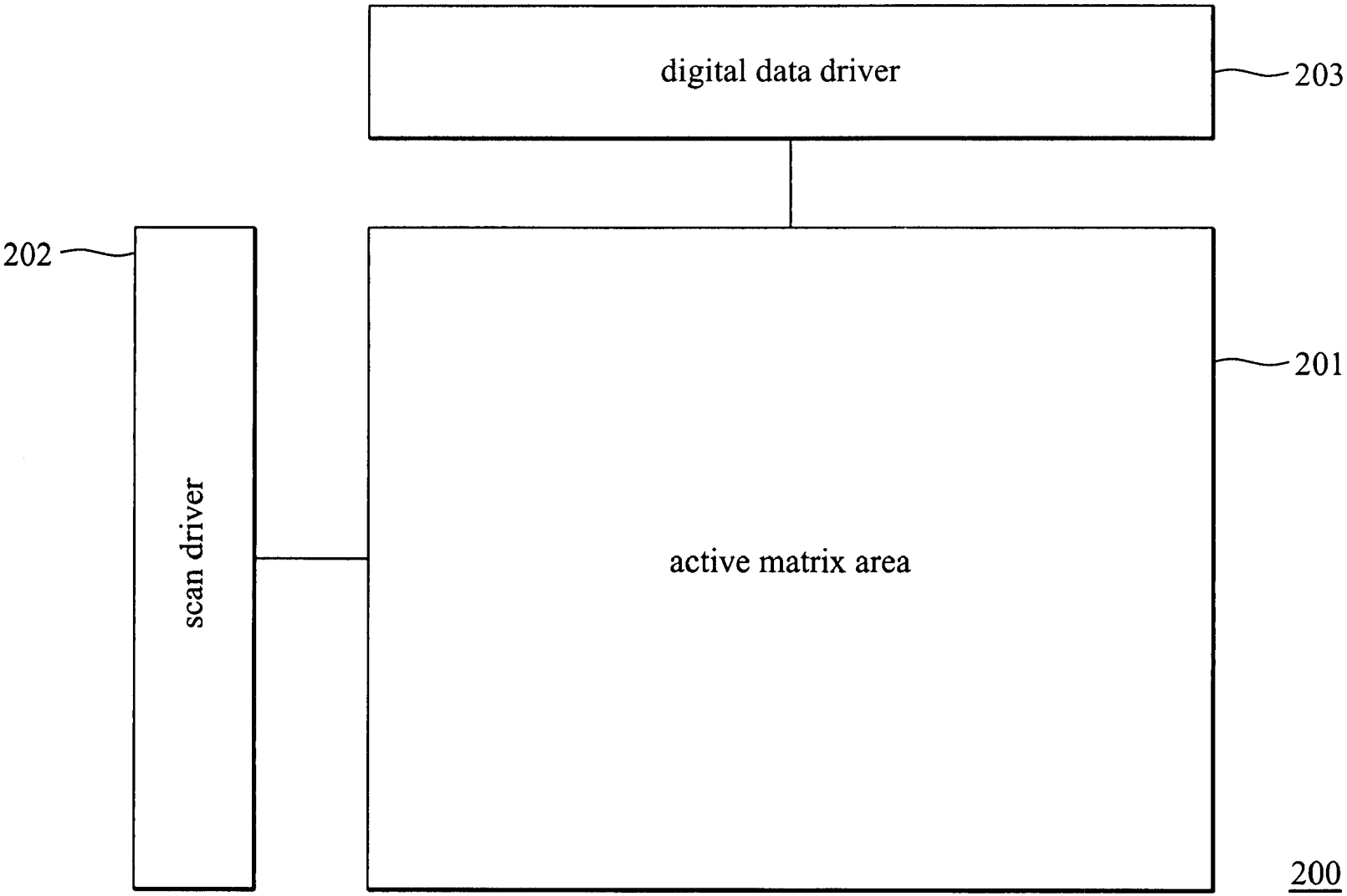
FIG. 2 is a diagram of the LCD according to the present invention.

FIG. 2 shows a liquid crystal display 200 with a digital data driver 203 of the present invention. As shown in FIG. 2, the liquid crystal display 200 has at least an active matrix region 201 consisting of a plurality of pixels, a scan driver 202, and a digital data driver 203. The scan driver 202 turns on one row of the pixels in the active matrix region 201 sequentially. The digital data driver 203 outputs data signals to corresponding pixels.

Figure 3:
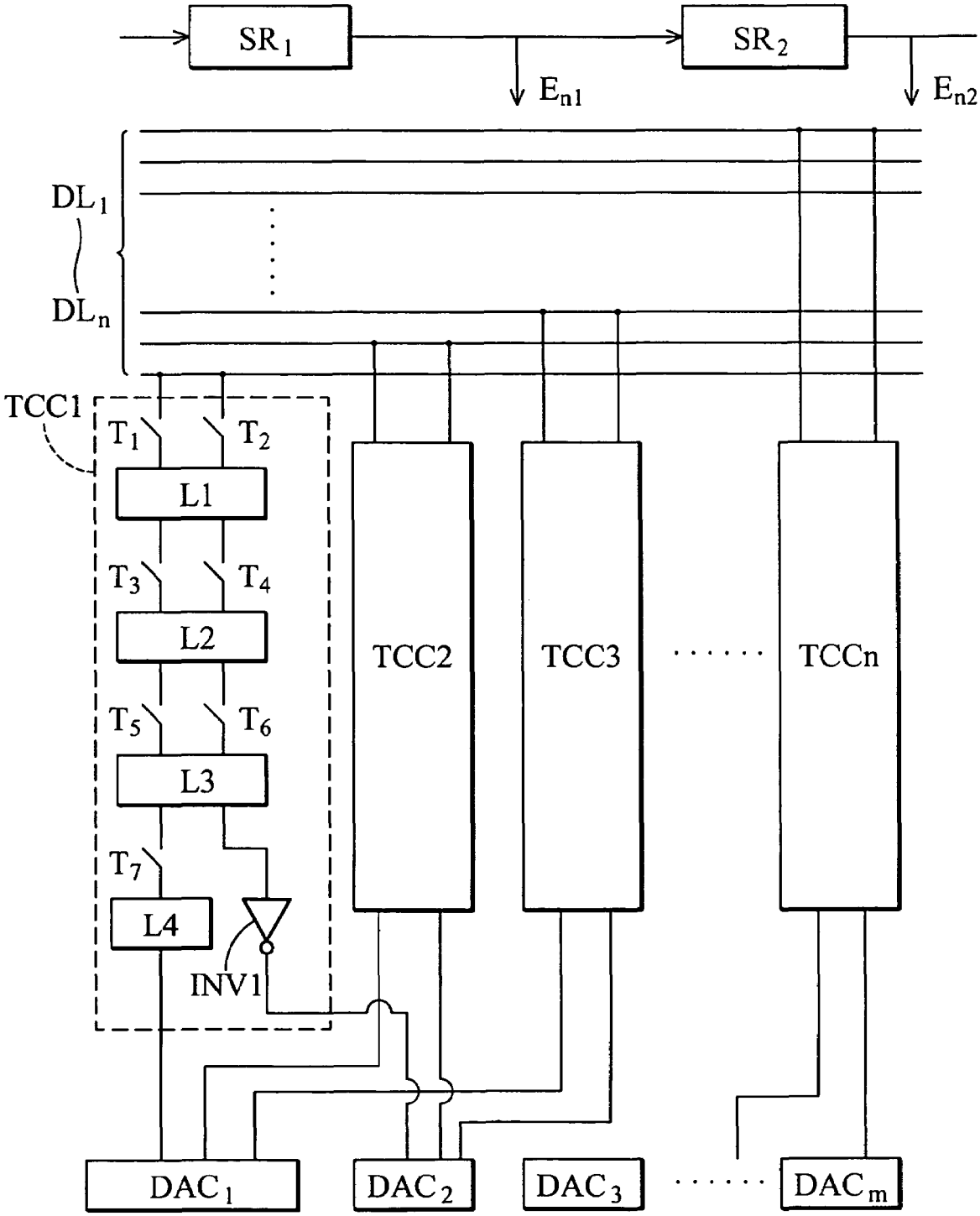
FIG. 3 is a diagram of the digital type data driver according to the present invention.
Figure 4B:
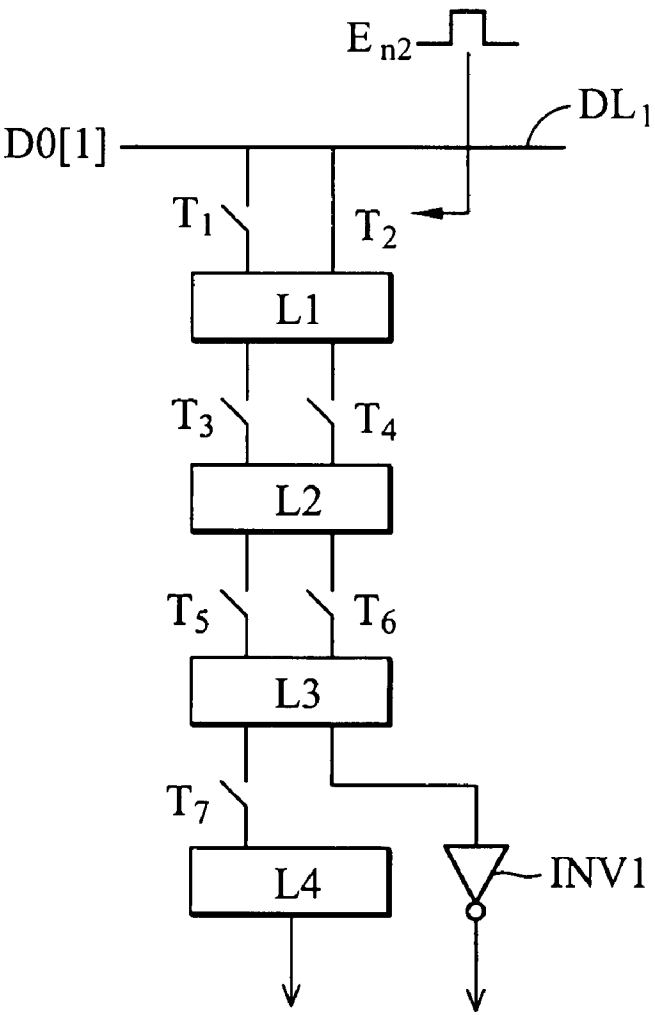
FIGS. 4A~4D show the operation of the transmission controller in the digital data driver according to the present invention.
Figure 4A:
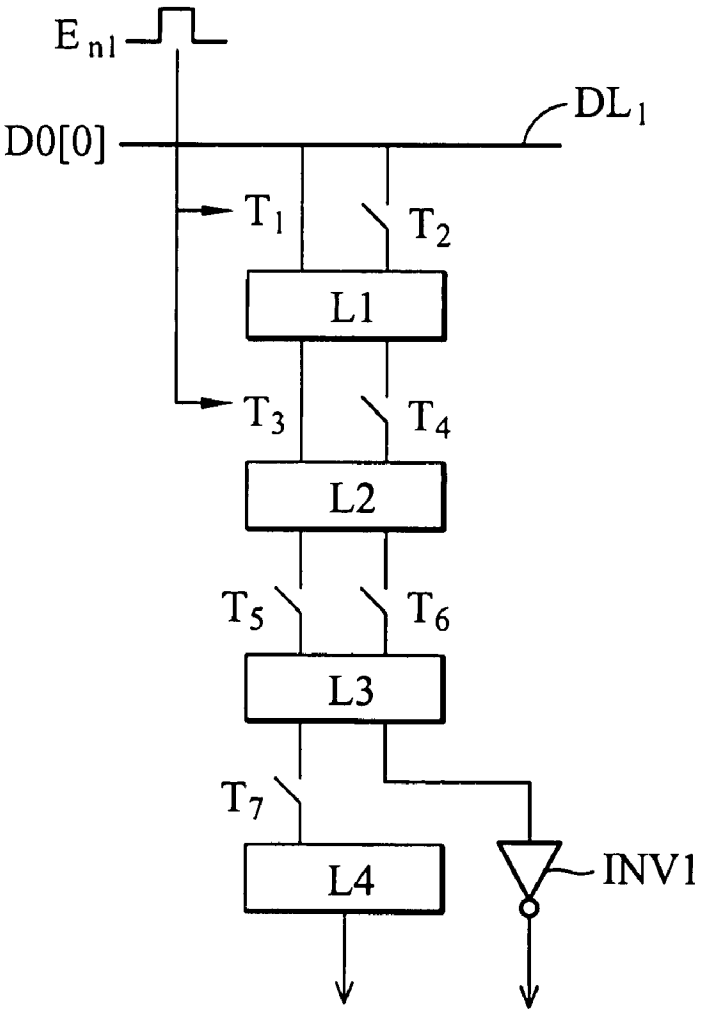
Figure 4D:
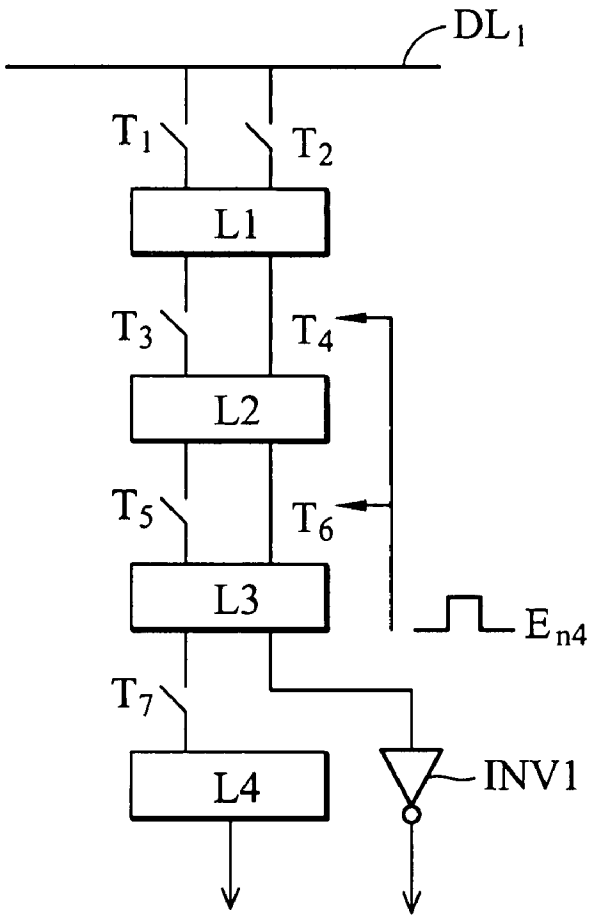
Figure 4C:
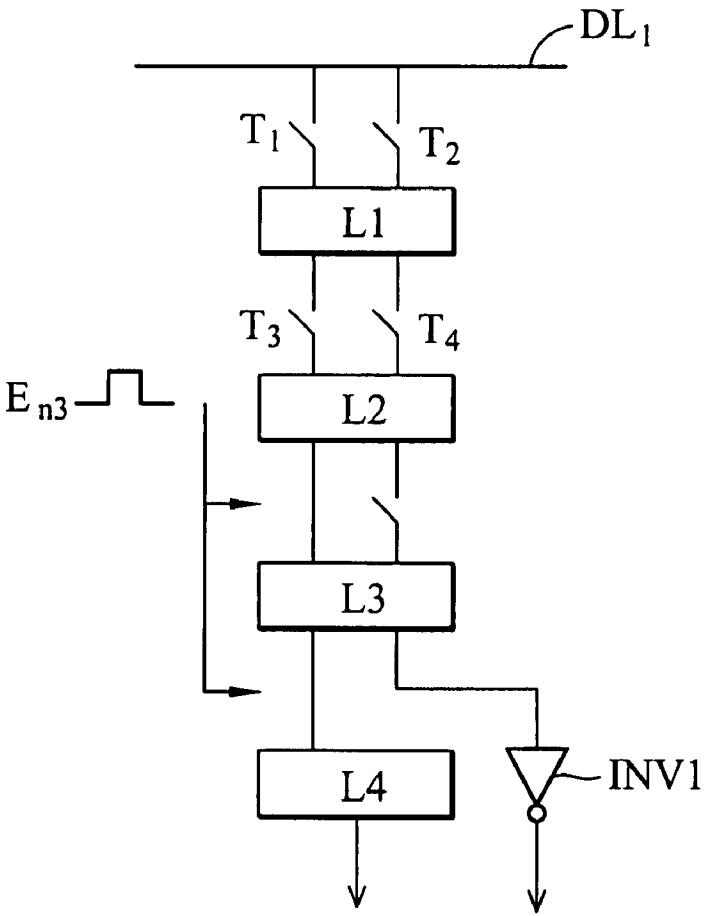

As shown in FIG. 3, the digital data driver 203 includes a plurality of data lines DL1~DLn, a plurality of shift registers ($SR_1$ and $SR_2$), and a plurality of transmission controller TTC1~TTCn.

The plurality of shift registers output an enable signal sequentially. In this case, the first shift register SR1 outputs a first enable signal $E_{n1}$ in the first period, and the second shift register $SR_2$ outputs a second enable signal En2 in the next period (the second period). The first period and the second period are in the same line period. Each of the data lines $DL_1$~$DL_n$ transmits first data in the first period, and transmits second data in the second period. Each of the transmission controllers TTC1~TCCn is coupled to a corresponding data line.

In each transmission controller TTC1~TCCn, first and second switching devices $T_1$ and $T_2$ are connected in parallel, each has a first terminal coupled to one of the data lines DL1~DLn and a second terminal coupled to an input terminal of the first latch L1. Third and fourth switching devices $T_3$ and $T_4$ are connected in parallel, each has a first terminal coupled to an output terminal of the first latch L1 and a second terminal coupled to an input terminal of the second latch L2. Fifth and sixth switching devices $T_5$ and $T_6$ are connected in parallel, each has a first terminal coupled to an output terminal of the second latch L2 and a second terminal coupled to an input terminal of the third latch L3. A seventh switching device $T_7$ has a first terminal coupled to an output terminal of the third latch L3 and a second terminal coupled to an input terminal of the fourth latch L4, wherein the output terminal of the fourth latch L4 is coupled to the first digital to digital converter DAC1. A first inverter INV1 has an input terminal coupled to the output terminal of the third latch L3 and an output terminal coupled to the second DAC DAC2.

Figure 5:
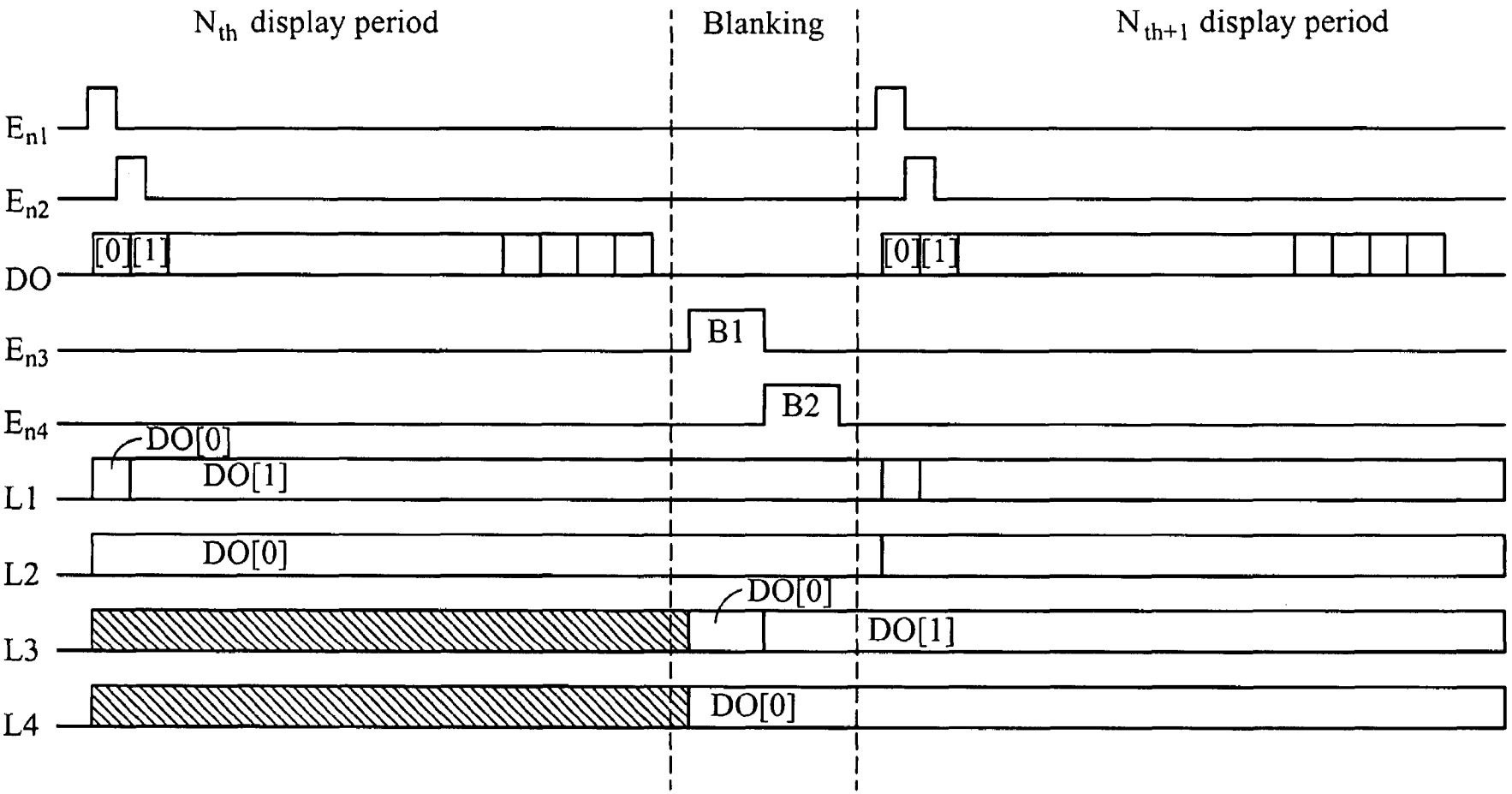
FIG. 5 is a wave diagram of the transmission controller according to the present invention.

FIGS. 4A~4D show the operation of the transmission controller in the digital data driver according to the present invention. FIG. 5 is a wave diagram of the transmission controller according to the present invention. The operation of the transmission controller in the digital data driver is described above with reference to FIGS. 4A~4D and 5.

The first shift register SR1 outputs a first enable signal $E_{n1}$ in the first period of Nth display period, and the first and switching device $T_1$ and $T_3$ are then turned on. Consequently, the first data D0 [0] on the data line DL0 is stored in latches L1 and L2.

The second shift register $SR_2$ outputs a second enable signal $E_{n2}$ in the next period (second period) of the Nth display period, and the first latch L1 is then turned on. Consequently, the second data D0 [1] on the data line DL0 is stored into the latch L1.

Typically, there is a blanking period (blanking) between the Nth display period and the Nth+1 display period.

The fifth and seventh switching devices $T_5$ and $T_7$ are turned on according to a third enable signal $E_{n3}$ from an external circuit in a period (B1) of a blanking period. The first data stored in the second latch L2 is then stored in the third and fourth latch L3 and L4, and outputs to a first DAC DAC1.

The fourth and sixth switching devices $T_4$ and $T_6$ are turned on according to a fourth enable signal $E_{n4}$ from an external circuit in the next period (B2) of the blanking period. The second data stored in the first latch L1 is then stored in the second and third latch L2 and L3, and outputs to a second DAC DAC1 through a first inverter INV1. In the present invention, the operation of the transmission controllers TCC2~TCCn is the same as the transmission controller TCC1 and for the sake of brevity the operation of the transmission controllers TCC2~TCCn is omitted here. Consequently, in the present invention, the digital data driver 203 can output digital data to the corresponding DACs DAC-R1~DAC-Rn, DAC-G1~DAC-Gn and DAC-B1~DAC-Bn according to the output signals from the shift registers $SR_1$~$SR_n$.

Figure 1A:
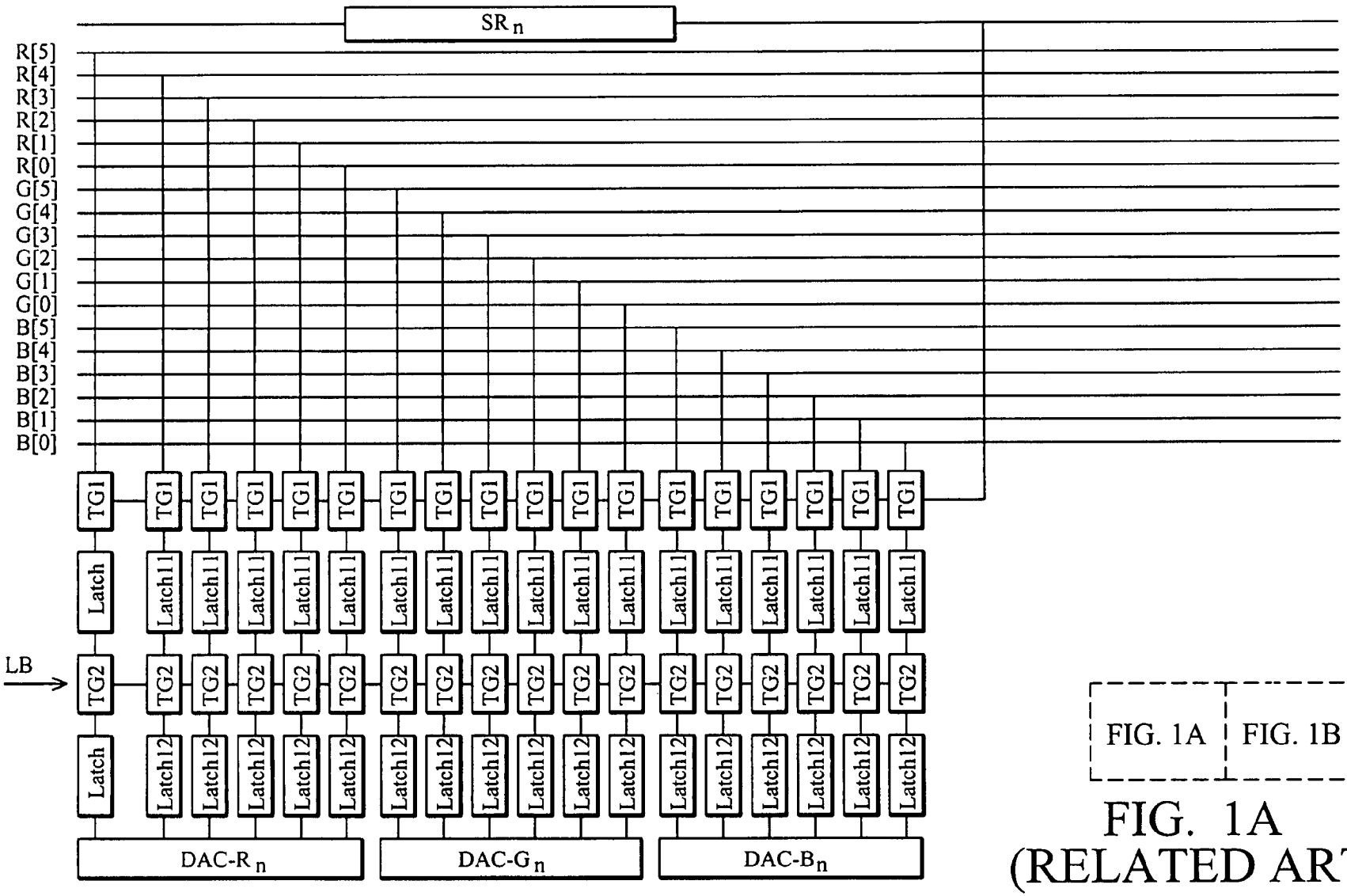
FIG. 1A (RELATED ART)
FIGS. 1A and 1B show the architectures of conventional digital data drivers.
Figure 1B:
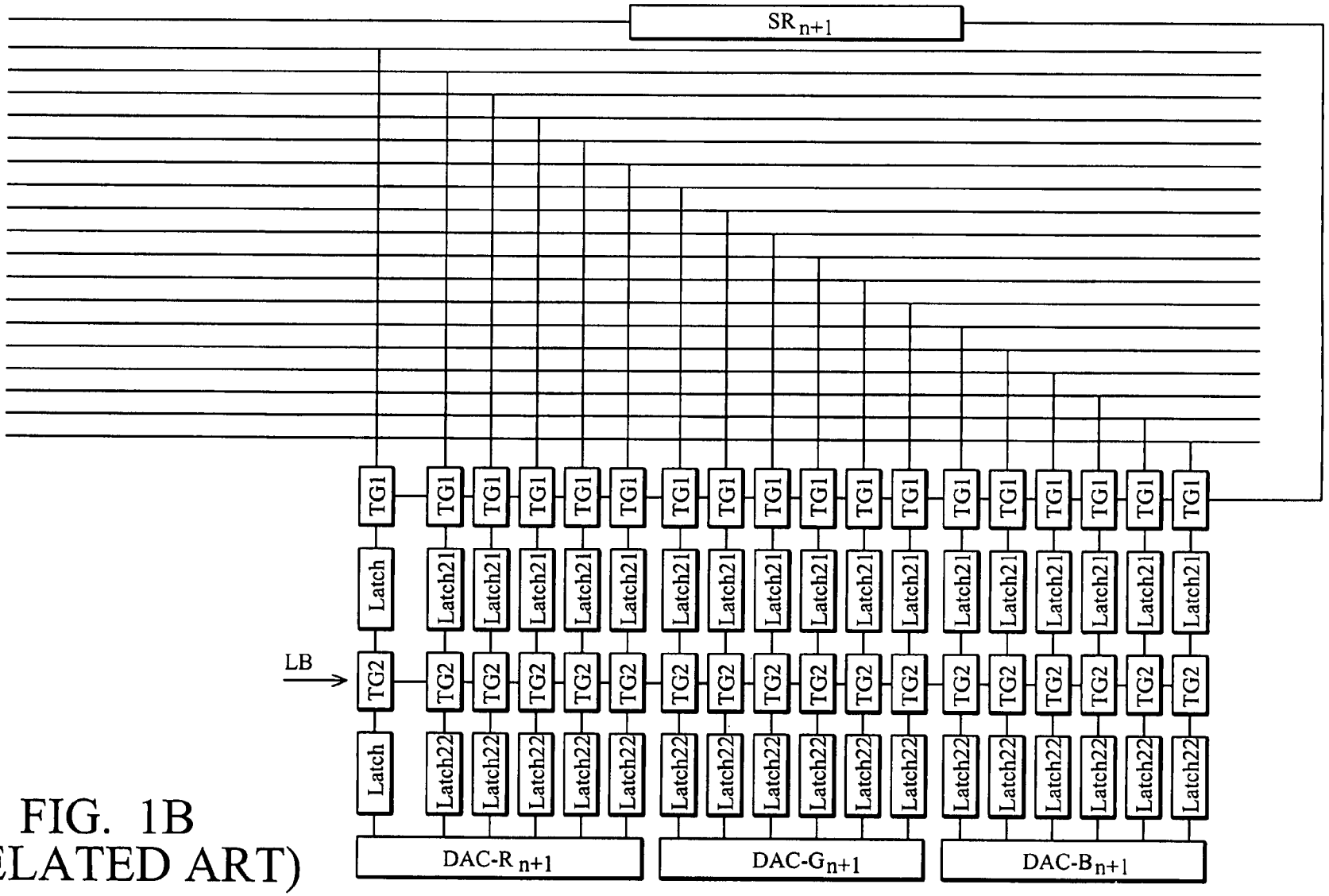
FIG. 1B (RELATED ART)
Figure 6:
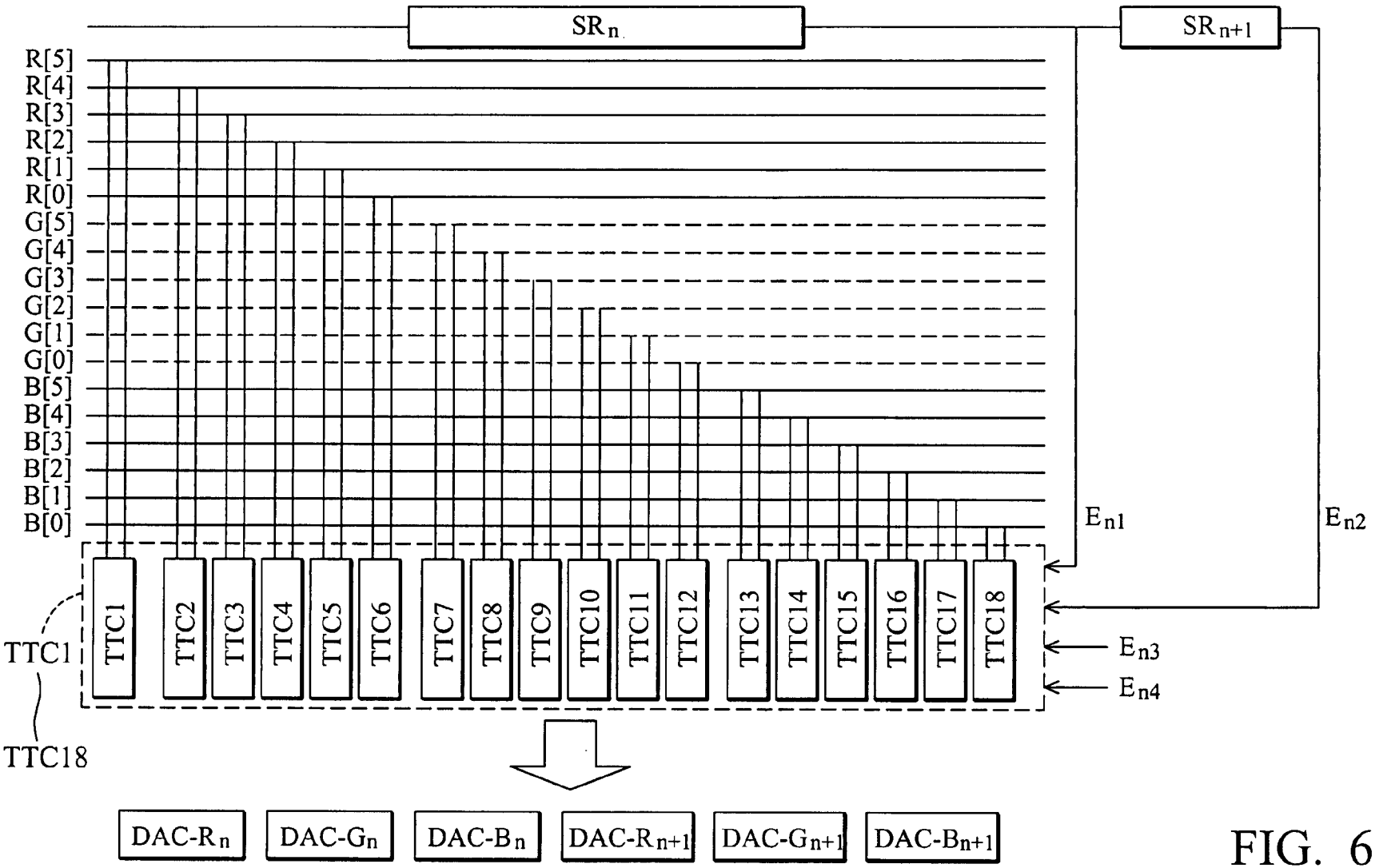
FIG. 6 shows the architecture of the digital data driver according to the present invention.

Therefore, the conventional digital data driver shown in FIGS. 1A and 1B can be replaced by the digital data driver of the present invention, as shown in FIG. 6, wherein the detailed circuit of the transmission controllers TCC1~TCCn are the same as those shown in FIG. 3.

According to the architecture of the present invention, the digital video data signals R[5]~B[0] (the first data) on the data lines are loaded into the corresponding second latches L2 by the enable signal from the shift register $SR_n$ in the first period of each horizontal scanning period. Next, the digital video data signals R1 [5]~B1 [0] (the second data) on the data lines are loaded into the corresponding first latches L1 by the enable signal from the shift register $SR_{n+1}$ in the second period of each horizontal scanning period. Thereafter, all the video signals R[5]~B[0] stored in the second latches (L2) are written to the fourth latches (L4), and input to the DACs (DAC-$R_n$, DAC-$G_n$ and DAC-$B_n$) simultaneously according to a third enable signal from an external circuit in the period (B1) of the blanking period. Next, all the video signals R1 [5]~B1 [0] stored in the first latches (L1) are written to the third latches (L3), and input to the DACs (DAC-$R_{n+1}$, DAC-$G_{n+1}$ and DAC-$B_{n+1}$) simultaneously through inverters according to a fourth enable signal from the external circuit in the nest period (B2) of the blanking period.

Therefore, by sharing latches and DACs, the digital data driver and LCD of the present invention prevents layout and wire routing difficulties caused by the increased lateral layout required by the increase in LCD resolution.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A digital data driver, comprising:

a plurality of data lines, each transferring first data during a first period and second data during a second period;

a first shift register outputting a first enable signal during the first period;

a second shift register outputting a second enable signal during the second period; and a plurality of transmission controllers coupled to the plurality of data lines respectively, each having first to fourth latches connected in series and a first inverter;

wherein each transmission controller stores the first data and the second data in the second latch and the first latch respectively according to the first enable signal and the second enable signal; each transmission controller outputs the first data stored in the second latch to the fourth latch and outputs to a first DAC according to a third enable signal; each transmission controller outputs the second data stored in the first latch to the third latch and outputs to a second DAC through the first inverter according to a fourth enable signal.

2. The digital data driver as claimed in claim 1, wherein the transmission controller further comprises:

parallel first and second switching devices, each having a first terminal coupled to one of the data lines and a second terminal coupled to an input terminal of the first latch;

parallel third and fourth switching devices, each having a first terminal coupled to an output terminal of the first latch and a second terminal coupled to an input terminal of the second latch;

parallel fifth and sixth switching devices, each having a first terminal coupled to an output terminal of the second latch and a second terminal coupled to an input terminal of the third latch; and a seventh switching device having a first terminal coupled to an output terminal of the third latch and a second terminal coupled to an input terminal of the fourth latch, wherein the first inverter has an input terminal coupled to the output terminal of the third latch.

3. The digital data driver as claimed in claim 2, wherein the first and third switching devices are turned on to store the first data in the second latch according to the first enable signal, the second switching device is turned on to store the second data in the first switching device according to the second enable signal, the fifth switching device and the seventh switching device are turned on to output the first data to the first DAC according to the third enable signal, and the fourth switching device and the sixth switching device are turned on to output the second data to the second DAC through the first inverter according to the fourth enable signal.

4. The digital data driver as claimed in claim 2, wherein the first to seventh switching devices are transmission gates.

5. The digital data driver as claimed in claim 2, wherein the first to seventh switching devices are switching transistors.

6. The digital data driver as claimed in claim 2, wherein the third enable signal and the fourth enable signal are produced in a third period and a fourth period in a blanking period, wherein the third enable signal controls the fifth switching device and the seventh switching device, the fourth enable signal controls the fourth switching device and the sixth switching device.

7. A liquid crystal display, comprising:

a plurality of pixels arranged in a matrix;

a scan driver turning on each row of pixels arranged in the matrix sequentially; and a digital data driver outputting data to the corresponding pixels, each comprising:

a plurality of data lines, each transferring first data during a first period and second data during a second period;

a first shift register outputting a first enable signal during the first period;

a second shift register outputting a second enable signal during the second period; and a plurality of transmission controllers coupled to the plurality of data lines respectively, each having first to fourth latches connected in series and a first inverter; wherein each transmission controller stores the first data and the second data in the second latch and the first latch respectively according to the first enable signal and the second enable signal; each transmission controller outputs the first data stored in the second latch to the fourth latch and outputs to a first DAC according to a third enable signal; each transmission controller outputs the second data stored in the first latch to the third latch and outputs to a second DAC through the first inverter according to a fourth enable signal.

8. The liquid crystal display as claimed in claim 7, wherein the transmission controller further comprises:

parallel first and second switching devices, each having a first terminal coupled to one of the data lines and a second terminal coupled to an input terminal of the first latch;

parallel third and fourth switching devices, each having a first terminal coupled to an output terminal of the first latch and a second terminal coupled to an input terminal of the second latch;

parallel fifth and sixth switching devices, each having a first terminal coupled to an output terminal of the second latch and a second terminal coupled to an input terminal of the third latch; and a seventh switching device having a first terminal coupled to an output terminal of the third latch and a second terminal coupled to an input terminal of the fourth latch, wherein the first inverter has an input terminal coupled to the output terminal of the third latch.

9. The liquid crystal display as claimed in claim 8, wherein the first and third switching devices are turned on to store the first data in the second latch according to the first enable signal, the second switching device is turned on to store the second data in the first switching device according to the second enable signal, the fifth switching device and the seventh switching device are turned on to output the first data to the first DAC according to the third enable signal, and the fourth switching device and the sixth switching device are turned on to output the second data to the second DAC through the first inverter according to the fourth enable signal.

10. The liquid crystal display as claimed in claim 8, wherein the first to seventh switching devices are transmission gates.

11. The liquid crystal display as claimed in claim 8, wherein the first to seventh switching devices are switching transistors.

12. The liquid crystal display as claimed in claim 8, wherein the third enable signal and the fourth enable signal are produced in a third period and a fourth period during a blanking period, wherein the third enable signal controls the fifth switching device and the seventh switching device, the fourth enable signal controls the fourth switching device and the sixth switching device.

13. The liquid crystal display as claimed in claim 9, wherein the first DAC and second DAC convert the first data and the second data into a first analog data and a second analog data and output to corresponding pixels respectively after receiving the first data and the second data.

14. The digital data driver as claimed in claim 1, wherein the transmission controller outputs the first data to the fourth latch through the third latch and outputs the second data to the third latch through the second latch.

15. The liquid crystal display as claimed in claim 7, wherein the transmission controller outputs the first data to the fourth latch through the third latch and outputs the second data to the third latch through the second latch.

* * * * *